United States Patent [19]

Rom

[11] Patent Number: 4,932,306

[45] Date of Patent: Jun. 12, 1990

[54] METHOD AND APPARATUS FOR LAUNCHING A PROJECTILE AT HYPERSONIC VELOCITY

[76] Inventor: Josef Rom, 28a Danya Street, Haifa, Israel

[21] Appl. No.: 157,472

[22] Filed: Feb. 18, 1988

[30] Foreign Application Priority Data

Apr. 13, 1987 [IL] Israel ..... 82200

[51] Int. Cl.[5] ..... F41F 1/00

[52] U.S. Cl. ..... 89/8; 102/436; 102/503; 102/501; 102/440

[58] Field of Search ..... 89/8; 244/63

[56] References Cited

U.S. PATENT DOCUMENTS

| | | | |
|---|---|---|---|
| 3,253,511 | 5/1966 | Zwicky | 89/8 |
| 3,468,217 | 9/1969 | Cooley | 89/8 |
| 4,722,261 | 2/1988 | Titus | 89/8 |
| 4,726,279 | 2/1988 | Kepler | 89/8 |

FOREIGN PATENT DOCUMENTS

| | | | |
|---|---|---|---|
| 248340 | 9/1987 | European Pat. Off. | 89/8 |

OTHER PUBLICATIONS

Knowlen et al., Performance Capabilities of the Ram Accelerator, AIAA/SAE/ASME/ASEE 23rd Joint Propulsion Conference, Jun. 29–Jul. 2, 1987, San Diego, Calif.

Hertzberg et al., The Ram Accelerator: A New Chemical Method of Achieving Ultrahigh Velocities, 37th Meeting of the Aeroballistic Range Association, Quebec, Canada, Sep. 9 12, 1986.

*Primary Examiner*—Stephen C. Bentley

*Attorney, Agent, or Firm*—Foley & Lardner, Schwartz, Jeffery, Schwaab, Mack, Blumenthal & Evans

[57] ABSTRACT

A projectile is accelerated to hypersonic velocity in an initially closed barrel of a diameter considerably larger than the projectile diameter which is filled with a compressed fuel-oxidizer mixture. The projectile comprises a conical nose portion, an intermediate portion formed to generate oblique detonation waves, and a tapering tail portion provided with several radial vanes. The projectile is propelled by an initiator gun at supersonic speed through one of the intitially closed ends in the barrel, were the detonation waves cause detonation and combustion of the fuel-oxidizer mixture. The detonation results in a high pressure increase to the rear of the projectile accelerating it along the barrel and shooting it at the reached hypersonic speed through the other, initially closed end of the barrel into the open.

35 Claims, 4 Drawing Sheets

METHOD AND APPARATUS FOR LAUNCHING A PROJECTILE AT HYPERSONIC VELOCITY

BACKGROUND OF THE INVENTION

The invention relates to a method of accelerating a projectile or a controlled missile to hypervelocity speeds (2 km/sec. to 12 km/sec.) utilizing external propulsion obtained by continuous detonation waves generated on a suitably designed planar-winged or axi-symmetric vehicle based on the "Waverider" concept. It relates more particularily to a method of propelling a projectile or a missile at the required velocity through a space filled with a pressurized fuel-oxidizer gas mixture, causing detonation and combustion of the gas mixture on the rear parts of the vehicle and thus obtaining forward thrust, without the necessity of fuel to be carried by the vehicle itself.

The concept of external propulsion based on the "Ram Jet" cycle, with combustion or detonation processes, was already proposed in the early 1960's for various hypersonic aircraft designs. However, it was found not to be practical because of the long path required for reasonable mixing of the injected fuel with the external airstream.

The principle of the "Ram Jet" cycle is as follows: air flowing into the ramjet engine is pressurized and decelerated by shock waves generated in the supersonic diffuser section. This deceleration can be done by utilizing a normal shock wave to subsonic velocity which is then directed to the combustion section where subsonic combustion of the injected fuel is accomplished. The high temperature-pressure combustion products are then expanded in a convergent-divergent nozzle to high velocity jet which imparts forward thrust on the complete engine. A more efficient cycle can be obtained if the ram deceleration is done by oblique shock waves to lower supersonic velocities, and fuel is injected and combustion is accomplished at supersonic speeds. The combustion products are then accelerated by an expanding nozzle to obtain forward thrust. Since there are difficulties in stabilizing supersonic combustion, there exist experimental programs to stabilize oblique detonation waves to produce the high temperature/high pressure combustion products.

A direct application of the Ram Jet process to accelerate projectiles to high velocities was developed by Prof. A. Hertzberg and his associates at the University of Washington, Seattle, Wash. in their "Ram Accelerator". Herein a properly shaped projectile is fired, by a gun or by other means, into and along a strong gun barrel filled with pressurized fuel-oxidizer gas mixture. The configuration of the projectile and the barrel correspond to the design of a "Ramjet" engine wherein the projectile acts as the centerpart on which the forward thrust is affected, while the gun barrel acts as the engine cowling. The drawback of this process lies in the high pressures which are inherently being generated on the barrel walls, and which increase considerably as the speed of the projectile is increased. This is due to the fact that the initial gas mixture pressure must be reasonably high, about 100–200 bars, in order to obtain the high thrust for the acceleration of the projectile; and final pressure on the barrel wall may be from 100 to 1000 times this value due to the shock wave structure required in order to obtain the Ram cycle which is the basic cycle of the "Ram Accelerator". Therefore the "Ram Accelerator" requires a very thick and heavy barrel of an extremely high weight at projectile velocities above 5–6 km/sec.

In order to alleviate this drawback it is the main object of the present invention to provide a method for propelling a projectile that utilizes the external propulsion concept instead of the ramjet concept to accelerate projectiles to hypervelocities. In this way the high pressures due to the shock and detonation waves are attached to the vehicle and the pressure rise due to the waves is lower when these arrive at the tube walls, which are remote from the projectile.

Since by this method a relatively large vehicle can be propelled at hypervelocity, it is another object of this invention to provide such a vehicle with controls—aerodynamic or propulsive—and guidance systems for locating a target and for directing and maneuvering the vehicle towards it.

It is still another object to provide the vehicle with additional propulsive systems such as rocket engines that will be initiated while the vehicle is in free flight and so to further accelerate the vehicle to still higher velocities beyond those obtained by the present method and device.

It is still another object to position a complete propelling system on the ground, in a fixed base or on a ground-transportable vehicle (armored or not).

It is still another object to provide means for firing a projectile from a device mounted on an aircraft or on a space vehicle.

It is another object to provide such a system, adapted to propel vehicles to velocities beyond the escape velocities from the earth gravitational force, with or without the assistance of rockets.

SUMMARY OF THE INVENTION

The invention is based on utilizing the external propulsion principles obtained by using stabilized detonation waves attached to configurations—3-D planar wings or axially-symmetric—based on the "Waverider" concept. The "Waverider" concept originated from the fact that at hypersonic speeds a Caret wing 1 shown in FIG. 1 will have a planar bow shock wave attached to the edges 6 of its inverted V-shaped plane surfaces 2. The high pressure region between the wave plane and the wing produces the lift force on this Caret wing which justifies the descriptive term—"Waverider". It has been suggested to arrange Caret wings in an axi-symmetric geometry to obtain a symmetrical wave-stabilized body for hypersonic flight, but up to now no satisfactory solution of supplying the necessary thrust has been found.

The method of accelerating a projectile to a very high supersonic velocity includes propelling a projectile or missile in the shape of a planar "Caret Wing" or of an axi-symmetrical body composed of several "caret wings", at a predetermined supersonic velocity into one end of an oblong vessel filled with a fuel-oxidizer gas mixture of a predetermined composition compressed to a predetermined pressure. The projectile is of a shape so designed that the nose shock wave will raise the fuel mixture to a temperature below its ignition point so as to prevent its early ignition, and means are provided at the end of the wing or wings serving to generate additional detonation shock waves which will raise the fuel gas temperature above this point, in order to cause detonation of the fuel to the rear of the projectile. The thrust on the rear end of the projectile caused by high temperature and pressure, shoots it through the vessel at ever-increasing speed, by the gradual combustion of the entire fuel contained in the vessel to the rear of the passing projectile. The projectile then pierces the other end of the vessel and escapes into the open at the maximum velocity reached at the end of its path through the vessel.

A preferred embodiment of a wing-shaped projectile comprises a relatively long nose portion, a shoulder portion and an afterbody portion, the shoulder being provided with a forward-facing step or ramp adapted to cause additional shock waves of sufficient intensity to raise the fuel temperature above its detonation point.

Similarly, an embodiment of an axi-symmetrical projectile comprises a long conical nose portion provided with radially extending vanes of rearwardly increasing height, a cylindrical intermediate portion similarly provided with shock wave generating means, and a tail portion of gradually diminishing diameter ending in a point. In a preferred embodiment the vanes of the nose portion are continued along the intermediate and tail portion, serving as fins for aerodynamic stabilization. The fins may include control surfaces and may be inclined in order to impart a spinning-rolling moment to the projectile.

Another embodiment of an axisymmetrical projectile comprises a solid, oblong body including a long conical nose portion with radially extending vanes of rearwardly increasing height, a tail portion of gradually decreasing diameter provided with outwardly extending fins in continuation of the vanes of the nose portion, and an intermediate portion in the form of a skirt separated from the central solid body by an annular space and being firmly attached to the outer edges of the tail fins. The skirt is preferably in the shape of a hollow cylinder, but it may likewise be in the form of flat plates extending between the outer edges of adjoining fins. The skirt may extend all along the tail portion or it may be of shorter length, starting from the rear end of the frontal vanes, its task is to generate oblique detonation shock waves extending from the frontal edge of the skirt towards the central solid body. The skirt is preferably detachable from the projectile body after this has left the vessel—by mechanical or by pyrotechnical means—in order to reduce drag, but it may be left in place with missiles or projectiles destined for flight in outer space.

The main advantage of the skirt is the confinement of the shock wave in the annular space created between the central body and the skirt causing an increase of pressure to the rear of the projectile, compared with the pressure generated to the rear of a projectile without skirt. The thus confined shock wave does not reach the walls of the enclosing vessel which, therefore, may be made just strong enough to withstand the initial pressure of the fuel-oxidizer gas mixture.

The projectile may be additionally provided with a control system as well as with jets for guiding and maneuvering it.

The vessel is preferably in the shape of a strong-walled barrel of a diameter large in comparison with the dimensions of the projectile, its two ends being either closed by membranes or by quick-opening valves.

In contradistinction to the Ram Accelerator effect, the wall of the barrel does not play any role in the projectile propulsion according to the present method, and it is proposed to make the barrel diameter just large enough for the shock waves to be sufficiently attenuated, so as not to unduly stress the barrel walls. On the other hand, the diameter should only be so large as not to require very strong walls designed to contain the gas pressure, which otherwise would make the entire device too unwieldy.

The projectile is initially fired into the barrel end by a projectile launcher or by a gun, suitable for giving the projectile the required muzzle velocity; however, since this implement is not the scope of the present invention, no specific description will be given thereof.

SHORT DESCRIPTION OF THE DRAWINGS

FIG. 1 illustrates a planar Caret Wing in flight,

FIG. 2 is a longitudinal section of a planar Caret Wing provided with a tail portion, showing the shock waves generated during supersonic flight, FIG. 3 is a side view of an axisymmetrical projectile comprising a conical nose portion with four radial vanes and a tapering tail portion, FIG. 4 is a rear view of the projectile shown in FIG. 3, along line A—A, FIG. 5 is a longitudinal section of an axisymmetrical projectile comprising a nose portion, a shoulder portion and a tail portion, as well as radial vanes extending along the entire length of the projectile, FIGS. 6, 7 and 8, show sections of the projectile of FIG. 5 along the lines B—B, C—C and D—D respectively, FIG. 9 is a longitudinal section of a projectile in a launching device of the invention, FIG. 10 is a longitudinal section of a projectile of the Caret-wing type provided with a tail portion, fins and a flat skirt between the outer edges of the tail portion, FIG. 11 is a section along line E—E of the projectile illustrated in FIG. 10, FIG. 12 is a side view of an axisymmetrical projectile similar to that illustrated in FIGS. 5, 6, 7 and 8, provided with a cylindrical skirt, FIG. 13 is a section along line F—F of the projectile illustrated in FIG. 12, and FIG. 14 illustrates a multiple barrel launching device.

DETAILED DESCRIPTION OF THE DRAWINGS

Figure 1:
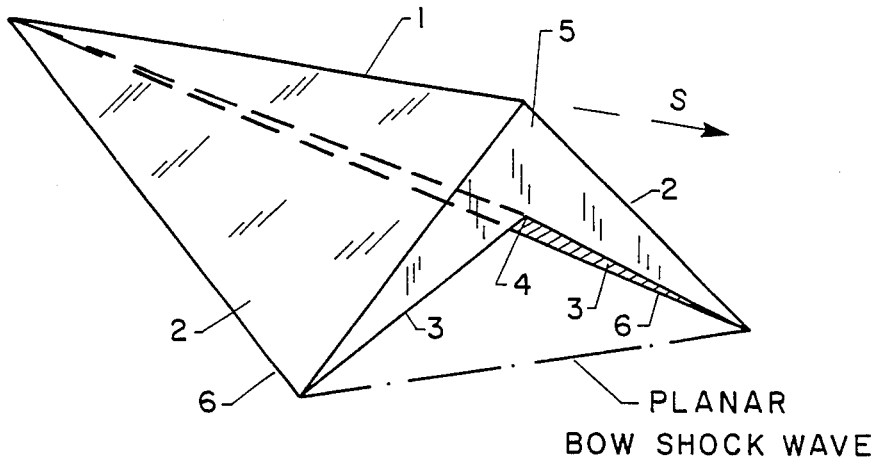
FIG. 1 (PRIOR ART)

A Caret Wing of known design is illustrated in FIG. 1: It is shaped like an arrow head in the form of an inverted "V", its upper ridge line 1 lying in the direction of the air stream S. The arrow head comprises two plane outer surfaces 2, and two planar inner surfaces 3 which intersect at a lower ridge line 4. The rear end 5 is in the shape of a planar surface about perpendicular to the upper ridge line 1. As learned in tests at supersonic velocity, a planar bow shock wave (BSW) forms between the leading edges 6, which generates a pressure and upward lift force, causing the configuration to be named "Waverider".

Figure 2:
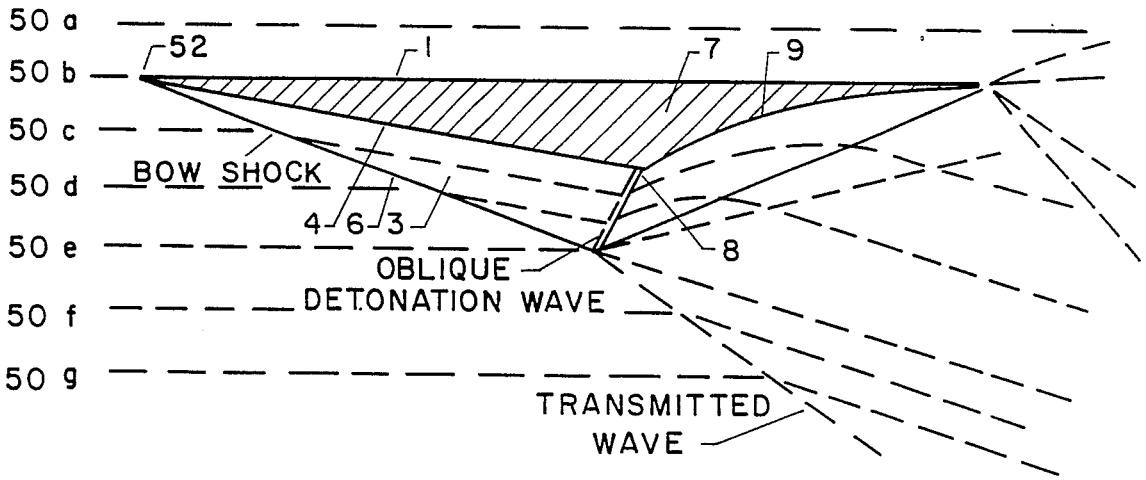
Figure 3:
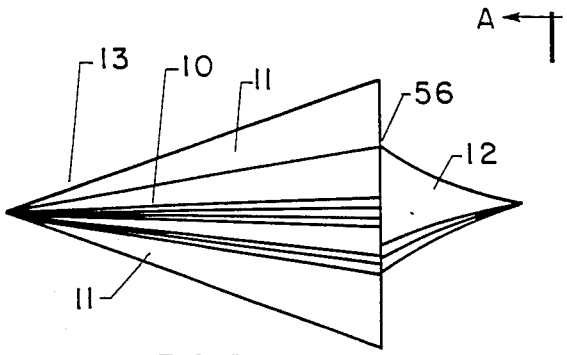
Figure 4:
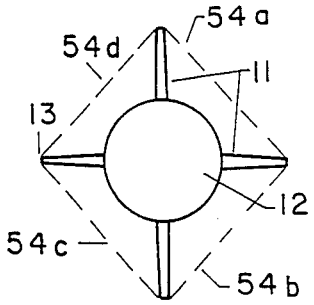

A projectile in the shape of a Caret Wing is not suitable for the described object of the invention, since it will not generate a forward thrust due to detonation of the fuel mixture in its rear. Accordingly, a tail portion 7 has been added to the configuration of FIG. 1, as shown in FIG. 2. In this FIG. the components corresponding to those illustrated in FIG. 1 are indicated by identical numerals, and in addition the drawing shows the flow lines 50*a*–50*g* and shock waves generated during supersonic velocity. As will be discussed in further detail below, two different shock waves are generated, a bow shock wave and an oblique detonation wave. In FIG. 2 the bow shock wave and the leading edges 6 lie in the same plane. The tail portion is continued along the upper ridge line 1, but forms a sharp edge 8 at the border between the original Caret Wing and the tail portion, created by the curved lower contours 9 of the latter. As can be seen from the drawing, a bow shock wave forms in a similar way to that shown in FIG. 1, serving to create the lifting force, but an additional oblique detonation wave is formed by a trigger of the shoulder 8 (step or ramp), generating the oblique detonation wave which serves to raise the temperature of the fuel mixture beyond the detonation point and causing ignition and detonation of the fuel in the launcher vessel, which expands explosively in the rear of the projectile. As mentioned before, the frontal part from the arrow point 52 to the shoulder 8 is long and is slowly increasing in thickness so as not to raise the gas temperature above the detonation point, while the tapering tail portion serves to expand the gas and thus to produce the required pressure and forward thrust. Thus, detonation is caused by the interaction of the bow shock wave and the oblique detonation wave. Since the bow shock wave and the oblique detonation wave are generated independently of the barrel wall, detonation occurs independently of the barrel wall.

FIGS. 3 through 8 illustrate two embodiments of axisymmetrical projectiles designed on the same principle as that used in designing the projectile shown in FIG. 2. Both embodiments comprise a nose portion in the form of a long cone, a tail portion of gradually diminishing diameter, and radial vanes. The projectile shown in FIGS. 3 and 4 includes a long slim cone 10 with four radial vanes 11 of triangular configuration integrally attached, and a rearwardly tapering tail portion 12 ending in a point. Herein, as in the embodiment of FIG. 2, bow shock waves 54*a*–54*d* are generated between the leading edges 13 of the vanes, oblique detonation waves (not illustrated) are formed at the edge 56 between the nose and the tail portion, and the tail portion serves to expand the gases with resulting forward thrust.

Figure 5:
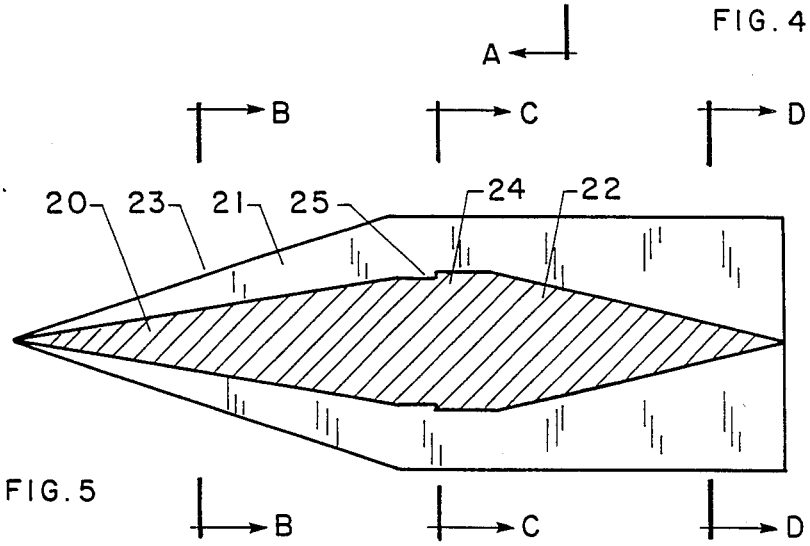
Figure 6:
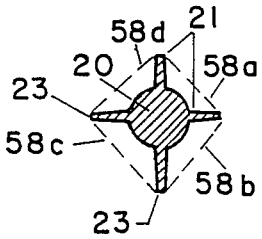
Figure 7:
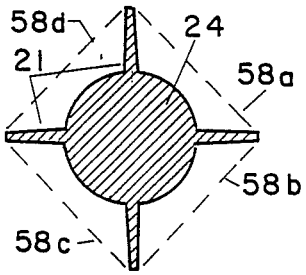
Figure 8:
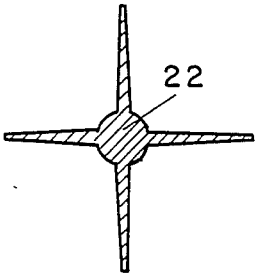

For improved flight conditions, the radial vanes 21 of the embodiment of FIG. 5 are continued right to the rear end of the projectile, the latter including a solid body comprising a conical nose portion 20, a tail portion 22, and an intermediate, cylindrical shoulder portion 24. The shoulder portion contains a forward-facing step 25 which serves to generate an oblique shock wave of sufficient intensity to raise the fuel temperature beyond the ignition point. Again, as in the afore-described embodiment, bow shock waves 58*a*–58*d* are generated between the leading edges 23 of the vanes in the nose portion, however the latter is designed in such a manner that the gas ignition temperature is not attained.

Figure 10:
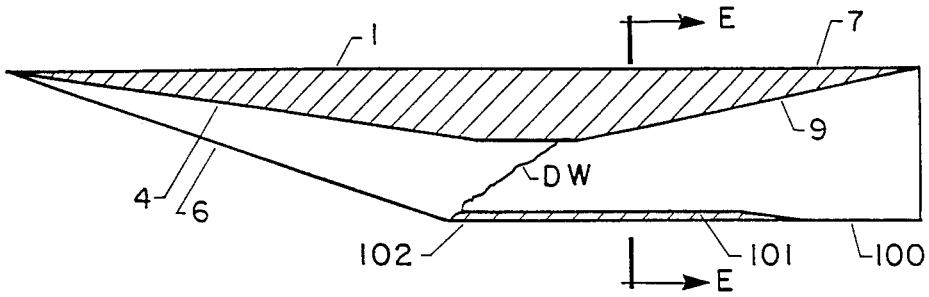
Figure 11:
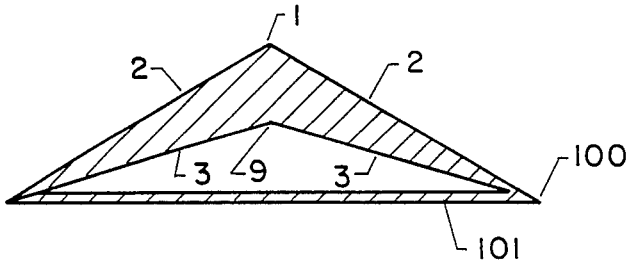

FIGS. 10 and 11 illustrate a projectile in the shape of a Caret Wing similar to that illustrated in FIG. 2, but with the difference that the lower ridge lines 100 of the triangular tail portion extend parallel to the upper ridge line 1. The ridge lines 100 are inter-connected by a skirt in the form of a thin plate 101 which extends from the rear ends of the leading edges 6 to about two thirds of the length of the ridge lines 100. The front edge 102 of the plate 101 creates, at supersonic speed, an oblique detonation wave DW, directed towards the inside of the wing which creates a high-pressure gradient in the free space between the plate 101 and the wing and behind the projectile, accelerating it in forward direction. The remaining parts of the projectile are identical with those of the wing of FIG. 2, and the same numerals have been employed to indicate identical parts and details.

Figure 12:
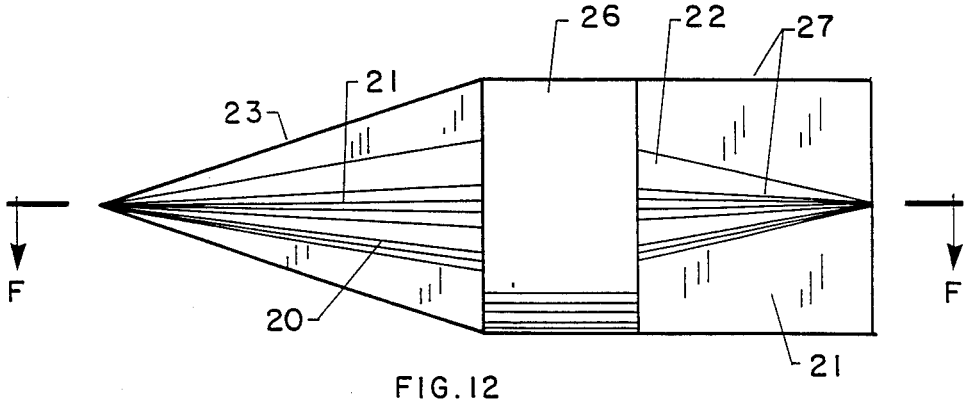
Figure 13:
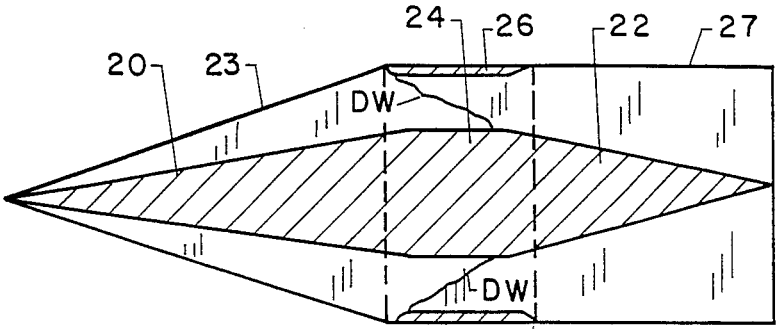

The projectile illustrated in FIGS. 12 and 13 is similar to that shown in FIGS. 5 through 8, but is characterized by the addition of a cylindrical skirt 26 attached to the outer edges 27 of the vanes 21 in the intermediate portion of the projectile, the front edge of which serves to create an oblique detonation wave DW, at supersonic speed, the wave being directed towards the intermediate portion of the body. It is understood that this arrangement replaces the circumferential step 25 of the projectile of FIG. 5, and this step has, therefore, been omitted in the present embodiment. All remaining parts of the projectile are identical with those of the projectile of FIG. 5 and have been marked by the same numerals.

Figure 9:
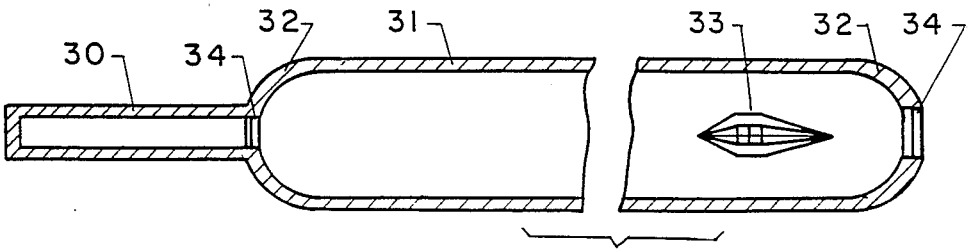

A projectile launching device is illustrated in FIG. 9. It comprises an initiation gun 30 and a launcher tube or barrel 31. The launcher tube has dished ends 32 for strength purposes which are centrally perforated by openings of a size co-extensive with the size of the projectile 33, the openings being initially closed by strong membranes 34 or quick-acting valves which will permit the passage of the projectile. The initiation gun is to be designed to effect acceleration of the projectile to a velocity of about 1700 to 2000 m/s. The launcher tube is shown to be cylindrical, which is a preferred configuration, but it may be of any other elongated shape as long as it can be designed to withstand the high initial and subsequently raised combustion gas pressure.

It will be understood that the aforedescribed embodiments constitute only a few examples of the various kinds and shapes of projectiles and launching apparatus which can be devised within the spirit of the invention, and for this reason a general description of the relevant features and the possible variations is being added, as follows: The nose shape is made very shallow so that the nose shock wave is sufficiently weak so that the temperature behind this shock will be lower than the detonation limit for the fuel-oxydizer gas mixture. It is therefore necessary to add to the Caret type forebody (either the wing or axisymmetric configuration) a shoulder section and an afterbody section. The shoulder section will include some means to generate and stabilize attached detonation waves. This can be achieved by aerodynamic means of a forward facing step or a ramp which will cause an additional shock wave of sufficient strength to raise the temperature to above the detonation limit of the fuel-oxidizer mixture. The detonation wave can be generated also by means of a pyrotechnic device or any other chemical or electrical means of raising locally the fuel-oxidizer temperature to that required to generate and stabilize the detonation wave. Such a detonation wave will be an oblique wave and its angle to the flow direction will be determined by the Chapmann-Jueget conditions. This detonation wave will result in high temperature and high pressure combustion products. The high pressure-and-temperature gas can now be expanded by the convergent-shaped afterbody to produce forward thrust (see FIG. 2). It is important to note that the forward thrust is generated solely by the flow pattern on the vehicle and does not depend on any presence of walls for shock reflections as is the case of the "Ram Accelerator". Therefore in the "Ram Accelerator" only a small clearance is allowed between the projectile and the barrel wall and the full pressure jump behind the reflected shock waves is applied on the barrel material. While in the present system the tube is required only in order to enable the containment of the fuel-oxidizer gas mixture at the required initial high pressure and can be of large dimensions to reduce the pressure signature of the shock waves generated on the vehicle.

The invention includes a launching system which includes the initiation gun and the launcher tube as shown in FIG. 9. The initiation gun can be a specially designed high-velocity gun enabling accelerating the projectile up to about 1700 to 2000 meters/sec. The launcher tube can be cylindrical or of any other elongated shape closed on both sides by diaphragms or quick-acting valves, so that it can contain the fuel-oxidizer gas mixture at the required initial pressure, which may be a few atmospheres up to a few hundred atmospheres. The projectile is then fired from the initiation gun entering the launcher tube by breaking the entrance diaphragm at initial speed which is sufficient to start the flow system which generates the external propulsion thrust. The projectile is accelerated going towards the other end of the tube reaching its maximum velocity and piercing the other diaphragm before going into free flight.

The projectile or missile must be properly shaped in order to insure forward thrust by external propulsion as well as aerodynamic performance in terms of the proper lift, possibly also slow or fast spin and stability characteristics to insure good flying qualities. The projectile can be either a wing-shaped vehicle as shown in FIG. 2, or of axisymmetric shape as shown in FIGS. 3 through 8. The projectile is comprised of a slender forebody based on a Caret wing or an axisymmetric Caret wing combination, a shoulder section which includes a device for generating and stabilizing the detonation waves, and the tail portion which includes a contraction section for accelerating the flow, and fins for aerodynamic stabilization. The fins can include control surfaces as well as inclination to cause spinning-rolling moment on the projectile. The projectile may be controled by deflection of control surfaces on the fins or by injection of jets causing side forces and moment on the projectile.

The projectile may include means for guidance and detection of targets as well as a control system to maneuver the projectile to perform its mission.

It is also pointed out that the vanes illustrated in FIGS. 5 through 8 are shown in an arbitrary shape, and that any other shape may be chosen, for instance as shown in FIG. 9, item 33. Likewise, any other number of vanes may be attached to the nose portion, instead of the four vanes shown in the drawing.

The nose portion may be in any pointed shape, not necessarily in the shape of a straight cone.

The vessel is not necessarily a permanent strong-walled tube or barrel, but may be disposable after one shot, which would permit its fabrication from a cheap material.

Figure 14:
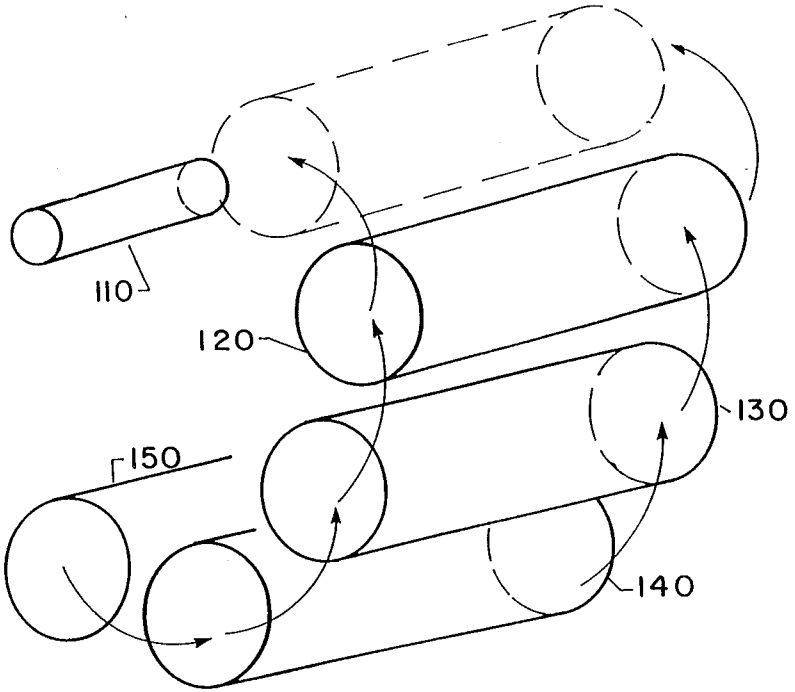

In order to increase the firing rate the propulsion device may include one gun or launcher and several fuel-gas-filled barrels rotatably arranged as illustrated in FIG. 14. One barrel after the other is brought in line with the gun, similarly to the principle of a Gatling-gun. FIG. 14 illustrates barrels 120, 130, 140 and 150 being successively brought in line with gun 110.

I claim:

1. A method of accelerating a body to a high velocity, comprising the steps of:

filling an oblong vessel with a compressed fuel-oxidizer mixture, said oblong vessel having initially closed ends and having a large inner diameter compared with outer dimensions of said body, propelling said body at supersonic velocity into said oblong vessel, said body generating bow shock waves and oblique detonation waves said bow shock waves and said oblique detonation waves intersecting and interacting within said oblong vessel prior to reaching an inner wall of said oblong vessel, detonating said fuel-oxidizer mixture with said oblique detonation waves causing forward thrust and acceleration of said body by pressure generated by denotation of said fuel-oxidizer mixture and expansion of high-pressure gases to the rear of said body.

2. A body propelled by the method as claimed in claim 1, having a nose portion in the shape of waverider of known design such as a planar Caret Wing, characterized by the addition of a tail portion of rearwardly diminishing cross section, and by the provision of a sharp edge at the border between said nose portion and said tail portion, adapted to generate detonation shock waves.

3. An axisymmetrical body propelled by the method as claimed in claim 1, comprising a long nose cone, a plurality of radial vanes of gradually increasing height integral with said nose cone, and a tail portion in the shape of a taper decreasing in diameter to a point at the rear end of said body.

4. The body of claim 3, comprising a conical nose portion, an intermediate portion, and a tapering tail portion, characterized by the provision of a plurality of radial vanes extending the entire length of said body, and by the provision on said intermediate portion of means adapted to generate oblique detonation waves.

5. The body of claim 4, comprising means for generating oblique detonation waves in the shape of a forward facing step on said intermediate portion.

6. The body of claim 4, comprising means for generating oblique detonation waves, in the shape of a ramp provided around said intermediate portion.

7. The body of claim 4, comprising means for generating oblique detonation waves in the shape of pyrotechnical means incorporated in said body.

8. The body of claim 4, comprising means for generating oblique detonation waves in the form of laser radiation means incorporated in said body.

9. The body of claim 4, provided with inclined vanes in said tail portion adapted to impart a spinning motion to said body.

10. The body of claim 4, provided with sideways directed jet means adapted for steering and maneuvering said body.

11. The body of claim 10, provided with target detecting means and jet operating means adapted to direct said body onto a target.

12. The body of claim 4, comprising means for generating oblique detonation shock waves in the form of a skirt surrounding said intermediate portion and at least part of said tail portion in spaced-apart alignment.

13. The body of claim 12, wherein said skirt extends between the outer edges of the fins of said tail portion.

14. The body of claim 13, wherein said skirt in the shape of a hollow cylinder.

15. The body of claim 13, wherein said skirt is in the shape of planar sheets extending between the outer edges of each two adjacent fins.

16. The body of claim 4, comprising a skirt adapted to be detached from said body after this has been expelled out of said oblong vessel.

17. An acceleration system comprising:

a first vessel filled with a combustible fluid;

a projectile, said projectile including a first wave generation means for generating a first wave and a second wave generation means for generating a second wave, said first wave and said second wave interacting, prior to reflecting off an inner wall of said first vessel, to cause detonation of said combustible fluid; and a tail, attached to said projectile, which directs combustion products resulting from said detonation of said combustible fluid so that said projectile is accelerated.

18. An acceleration system as set forth in claim 17, wherein said first wave is a bow shock wave and said second wave is an oblique detonation wave.

19. An acceleration system as set forth in claim 17, further comprising:

a gun which imparts an initial motion on said projectile such that said projectile is moving at a high rate of speed as said projectile enters said first vessel.

20. An acceleration system as set forth in claim 18, wherein said first wave raises the temperature of said combustible fluid to a temperature below a detonation point of said combustible fluid; and wherein said second wave raises the temperature of said combustible fluid to a temperature above said detonation point of said combustible fluid.

21. An acceleration system as set forth in claim 19, further comprising:

a second vessel filled with a combustible fluid, said first vessel and said second vessel being arranged so that said first vessel is in line with said gun during a first time period and said second vessel is in line with said gun during a second time period.

22. An acceleration system as set forth in claim 19, further comprising:

a first membrane located at a first end of said first vessel; and a second membrane located at a second end of said first vessel; wherein said fluid is a fuel-oxidizer gas mixture; and wherein said gun shoots said projectile through said first membrane into said first vessel at supersonic velocity, and said projectile exits said first vessel through said second membrane.

23. An acceleration system as set forth in claim 20, wherein said first wave generation means is a nose of said projectile; and wherein said second wave generation means is a forward facing step in a surface of said projectile.

24. An acceleration system as set forth in claim 20, wherein said first wave generation means is a nose of said projectile; and wherein said second wave generation means is a sharp edge in a surface of said projectile.

25. An acceleration system as set forth in claim 20, wherein said first wave generation means is a nose of said projectile; and wherein said second wave generation means is a ramp in a surface of said projectile.

26. An acceleration system as set forth in claim 20, wherein said first wave generation means is a nose of said projectile; and wherein said second wave generation means is a planar surface of a skirt;

said planar surface arranged such that said planar surface is not at a blunt angle with respect to a direction of travel of said projectile.

27. An acceleration system as set forth in claim 20, wherein said first wave generation means is a nose of said projectile; and wherein said second wave generation means is a pyrotechnic device.

28. An acceleration system as set forth in claim 20, wherein said first wave generation means is a nose of said projectile; and wherein said second wave generation means is an electrical device.

29. An acceleration system as set forth in claim 20, wherein said first wave generation means is a nose of said projectile; and wherein said second wave generation means is a light emitting device.

30. An acceleration system as set forth in claim 21, further comprising:

third through N-th vessels each filled with a combustible fluid, said third through N-th vessels successively brought in line with said gun, where N is an integer.

31. A method of accelerating a projectile comprising the steps of:

(a) injecting said projectile into a space filled with a combustible fluid in a first direction, said space being at least partially enclosed by a barrel;

(b) generating a first wave from a first portion of said projectile;

(c) generating a second wave from a second portion of said projectile, said second wave reacting with said first wave, prior to said second wave reflecting off an inner wall of said barrel and prior to said first wave reflecting off said inner wall of said barrel, to detonate said combustible fluid and to produce combustion products; and (d) directing said combustion products to accelerate said projectile in said first direction.

32. A method of accelerating a projectile as set forth in claim 31 above wherein step (b) includes raising the temperature of said combustible fluid to a temperature below a detonation point of said combustible fluid; and wherein step (c) includes raising the temperature of said combustible fluid to a temperature above said detonation point of said combustible fluid.

33. A method of accelerating a projectile as set forth in claim 31 above wherein step (b) includes raising the temperature of said combustible fluid to a temperature below a detonation point of said combustible fluid; and wherein step (c) includes raising the temperature of said combustible fluid using a pyrotechnic device to a temperature above said detonation point of said combustible fluid.

34. A method of accelerating a projectile as set forth in claim 31 above wherein step (b) includes raising the temperature of said combustible fluid to a temperature below a detonation point of said combustible fluid; and wherein step (c) includes raising the temperature of said combustible fluid using an electrical device to a temperature above said detonation point of said combustible fluid.

35. A method of accelerating a projectile as set forth in claim 31 above wherein step (b) includes raising the temperature of said combustible fluid to a temperature below a detonation point of said combustible fluid; and wherein step (c) includes raising the temperature of said combustible fluid using a light emitting device to a temperature above said detonation point of said combustible fluid.

* * * * *